US005120237A

United States Patent [19]

Fussell

[11] Patent Number: 5,120,237

[45] Date of Patent: Jun. 9, 1992

[54] SNAP ON CABLE CONNECTOR

[76] Inventor: Don L. Fussell, 16818 Bobcat Trail, Cypress, Tex. 77429

[21] Appl. No.: 733,658

[22] Filed: Jul. 22, 1991

[51] Int. Cl.[5] ..... H01R 13/00
[52] U.S. Cl. ..... 439/282
[58] Field of Search ..... 439/271-277, 439/278-282

[56] References Cited

U.S. PATENT DOCUMENTS 3,601,761 8/1971 Harris ..... 439/281
3,842,393 10/1974 Glover et al. ..... 439/281
4,637,674 1/1987 Kobler ..... 439/271

*Primary Examiner*—Joseph H. McGlynn
*Attorney, Agent, or Firm*—Dodge, Bush, Moseley & Riddle

[57] ABSTRACT

In accordance with an illustrative embodiment of the present invention, a right angle connector assembly includes a molded elastomer plug body having a rigid thermoplastic insert member mounted and bonded therein, such insert member having sockets that mate with pins on a receptacle that also is made of a rigid thermoplastic material. An upper tubular portion of the receptacle carries a silicone O-ring seal that snaps into an internal recess in the lower portion of the body when the connector is made up to prevent entry of moisture and provide a releasable detent latch.

16 Claims, 1 Drawing Sheet

SNAP ON CABLE CONNECTOR

FIELD OF THE INVENTION

This invention relates generally to a connector apparatus for electrically connecting the conductors of a seismic cable to the terminals of an analog-to-digital converter, and particularly to a new and improved right-angle connector that snaps together and provides a low profile assembly that is less subject to damage in the field.

BACKGROUND OF THE INVENTION

Electronic converters have come into use in seismic exploration field operations which change the analog output signals produced by geophones to digital signals that can be processed more readily by computer. One converter that is used is housed in an enclosure that is about the size of a large storage battery box, and has four multi-pin terminals located in recessed areas adjacent the upper corners of its case. Geophone cables are plugged into two of the terminals, and power and output cables are plugged into the other two terminals. The connector assemblies that have been used to plug in the seismic cables are long, upstanding tubular devices which have a bayonet pin and slot coupler on their lower ends. Cables emerge from the tops of these devices, so that the overall assemblies are quite high. In fact the connector sticks up in the air to the extent that it produces wind noise signals, somewhat like a flag, which degrade the signal-to-noise ratio of the seismic signals. The bayonet pins are likely to break out during handling, and it has been observed that they indeed tend to break off after a relatively low number of make and break connections. Another practical problem in use of those connectors is that quite often field personnel use mittens to protect their hands against cold temperatures, which makes the hand rotation of bayonet and slot couplers that is necessary to achieve connection or release difficult to achieve. Of course, it also will be recognized that a tall connector is apt to be broken off during handling or on account of other mishap, which will necessitate time consuming and expensive repairs.

The general object of the present invention is to provide a new and improved right-angle, low profile connector which can be easily snapped on and off of a multi-pin receptacle of a seismic signal converter or the like.

SUMMARY OF THE INVENTION

This and other objects are attained in accordance with the concepts of the present invention through the provision of a snap-on connector assembly having pin sockets that are arranged at a right angle to the longitudinal axis of the input signal cable. The upper body of the connector is made of a molded, relatively flexible elastomer and has a downwardly-opening recess that receives a rigid thermoplastic insert which has the arrangement of pin sockets formed therein. A molecular bond is formed between external walls of the insert and confronting surfaces of the elastomer body which joins the insert to the body. The receptacle on the converter box also is made of a rigid thermoplastic material and carries pins which mate with the sockets on the body insert. The receptacle has an external annular groove therein that receives a replaceable silicone O-ring seal. When the body is pushed onto the receptacle to make up the connector, the outer portion of the seal ring snaps into an internal annular recess which is formed in a lower skirt portion of the connector body. The seal ring prevents entry of moisture, and provides a releasable interlock between the body and the receptacle.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
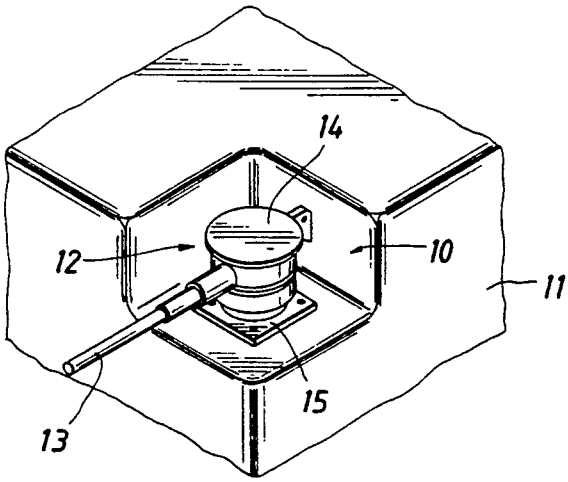
FIG. 1 is a schematic view of an upper corner area of a converter box having a receptacle which mates with a connector body in accordance with the present invention.

FIG. 1 shows an upper corner region 10 of an enclosure or box 11 which houses various electrical circuits which convert analog seismic signals that are fed from geophones by a leader cable 13 to digital signals. A multi-pin connector assembly 12 including a plug body 14 and a receptacle 15 is used to connect the conductor wires within the cable 13 to electrical circuits within the box 11. Another multi-pin receptacle usually is located at the upper corner of the box 11 that is opposite the connector assembly 12, and other cables such as a power cable and an output cable are connected to receptacles located at the remaining two corners of the box 11. However these connectors are not shown to simplify this disclosure. In accordance with one aspect of the present invention, the connector assembly 12 has a right-angle construction where the axes of the pin and socket connectors are each at a right angle to the longitudinal axis of the seismic cable 13. This gives a low profile arrangement that does stick up much, if any, beyond the upper surfaces of the box 11.

Figure 2:
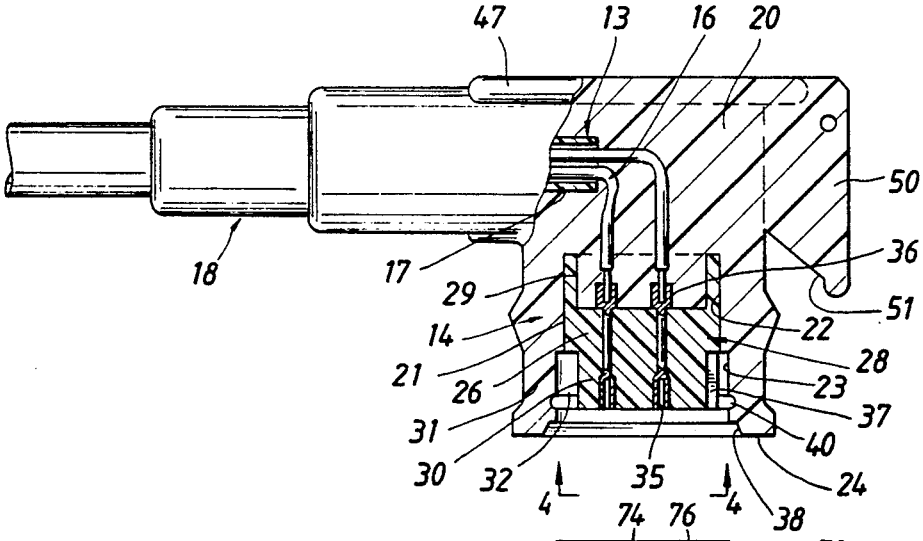
FIGS. 2 and 3 are cross-section views of the plug and receptacle assemblies of FIG. 1.

As shown in FIG. 2, the seismic cable 13 has a plurality of pairs of insulated electrical conductors 16 within a protective outer sheath 17. The cable 13 extend through a stress relief portion 18 and into the upper portion 20 of the connector body 14. The body 14 is generally cylindrical in form and has an internal cavity with stepped wall surfaces 22, 23 which opens through the bottom surface 24 of the body. The lesser diameter upper portion of the cavity 21 receives the upper portion 26 of a rigid thermoplastic insert member 28, such upper portion having an upstanding annular flange 29. A reduced diameter lower portion 30 of the insert member 28 extends downward into the larger diameter lower portion 31 of the cavity 21 with lateral clearance to provide an annulus 32 therebetween.

A plurality of pin sockets 35 are arranged in a pattern and are embedded in the insert member 28 as shown in FIG. 2. The number of pin sockets 35 usually corresponds to the number of conductor wires in the cable 13, and the end portion of each wire is curved downward and attached to a respective pin at the point 36. A radial key 37 is formed as an integral part of the lower portion of the insert member 28 and is used to orient the sockets 35 with respect to companion pins on the receptacle 15. A chamfered internal surface 38 is formed at the entrance end of the lower portion 39 of the body 14, and an internal annular recess 40 having a semi-circular section is formed in the inner wall of the lower portion above the surface 38.

Figure 3:
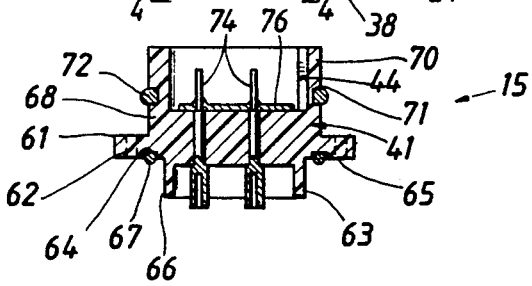
Figure 4:
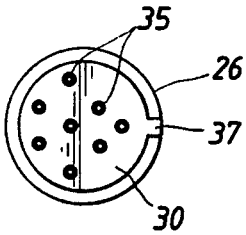
FIG. 4 is a view taken on line 4—4 of FIG. 2.

As shown in FIG. 3, the receptacle 15 includes a male member or body 41 that is fixed to the upper wall of the box 11 in a suitable manner.

For example the member 41 can have a square base flange 61 with holes 62 at each corner which receives screws (not shown) that attach the body to the box. A reduced diameter skirt 63 extends through the wall of the box 11, and an annular recess 64 can be formed in the lower face 65 of the flange 61 adjacent the outer surface 66 of the skirt 63. The recess 64 receives a standard O-ring 67 which is squeezed against the upper wall surface of the box 11 when the screws are tightened. The O-ring 67 prevents entry of moisture into the box 11 past the flange 61.

The body of the receptacle 60 is additionally formed with an enlarged diameter intermediate section 68 and an upper tubular section 70 that has an external annular groove 71 formed at the lower end thereof. The groove 71 has a width dimension that is substantially equal to the o.d. of a silicone O-ring seal 72 that is positioned therein. The depth of the groove 71 is made such that about 75% of the radial thickness of the O-ring 72 is received within the groove, which is a construction that applicant has found to prevent roll-out of the O-ring 72 when the connector is made up or separated. The seal 72 prevents entry of moisture, and provides a releasable detent connection between the connector body 14 and the receptacle 15. The upper section 70 has a radial keyway or slot 44 that receives the orienting key 37 on the insert member 28 to ensure axial alignment of the pins 74 with the sockets 35 when the connection is made up.

In a preferred embodiment, the upper end of the body 14 can be provided with an outwardly directed flange 47 to provide a finger grip which aids in removing the body from the receptacle 15 where it is desired to do so. A vertically extending rib 50 having an upwardly and inwardly inclined lower surface 51 also can be provided to serve as a fulcrum for a hand tool such as a screw driver that can be used to aid in disconnecting the assembly.

As shown in FIG. 3, a plurality of the sockets 35 are arranged in a selected pattern to mate with the pins 74 which extend through the middle section 68 of the body 41 from the region inside the upper tubular section 70 to the region inside the skirt 63 where various conductor wires inside the box 11 are attached thereto. An insulator disc 76 can be used to stabilize the pins in the pattern shown.

OPERATION

In use of the present invention, the connector members 13, 14 are made as described herein and as shown in the drawings. The receptable 14 is attached to the upper wall of the converter box 11 as shown in FIG. 1 after the lower ends of the pins 74 have been electrically connected to appropriate conductor wires in the box. To attach the plug member 14, and thus the conductors 16 in the seismic cable 13 to the pins 74 of the receptacle 15, the body 14 is positioned over the receptacle 15 and oriented such that the key 37 is aligned with the keyway 40. Then the body 11 is pushed down to cause the skirt 31 to telescope over the upper portion 20 of the receptacle 15. The silicone O-ring seal 72 engages the chamfer surface 38 and causes the lower region of the skirt 31 to temporarily enlarge and allow the O-ring to be positioned opposite the recess 40. Then the resilience of the skirt 31 causes it to resile inward and capture the outer portion of the O-ring 72 in the recess 40. The seal ring 72 prevents entry of moisture, and provides a releasable detent which secures the connector body 14 to the receptacle 15. When the body has moved fully downward, the pins 74 engage the sockets 35 to complete the electrical connections.

Due to the right angle construction of the present invention, the top of the body 14 does not extend beyond the uppermost surfaces of the box 11. Thus no wind noise signals are generated. It is virtually impossible for any lateral force to be applied to the body 14 which would cause breakage of component parts, due to the low profile of the connector assembly 12. The body 14 can be disengaged from the receptacle 15 by simply pulling up on the flange 47. If need be, a screw driver or the like can be used to pry up on the rib 50. Proper make up of the connector assembly 12 is signaled by the snapping of the O-ring 72 into the internal recess 40 of the body skirt 31, which usually is audible. The engagement of the O-ring 72 also can be felt since there is a sudden reduction in the outer diameter of the skirt 31 as the recess 40 engages the O-ring 72.

The rigid thermoplastic material from which the receptacle 15 is made provides a hard seat for the silicone O-ring 72 which will not cold flow or extrude and thereby cause a loss of sealing integrity.

It now will be recognized that a new and improved right-angle, snap-on connector assembly has been disclosed for attaching a seismic cable to a signal converter box. Since certain changes or modifications can be made in the disclosed embodiment, or its various component parts, without departing from the inventive concepts involved, it is the aim of the following claims to cover all such changes and modifications that fall within the true spirit and scope of the present invention.

What is claimed is:

1. Seismic connector apparatus comprising: a generally cylindrical body having an outer portion and an inner portion, said body being adapted to have a plurality of insulated electrical conductors enter said outer portion along an axis that is substantially at a right angle to the longitudinal axis of said body; an insert member bonded within the said inner portion of said body and carrying a first plurality of electrical connection means adapted to be connected to said electrical conductors, said insert member having an inner section defining an outer wall surface that is laterally spaced from inner wall surfaces of said inner portion of said body to form an annular space therebetween; receptacle means adapted to be mounted on a wall of an enclosure, said receptacle means having an outer tubular portion that is arranged to be received in said annular space, said receptacle carrying a corresponding second plurality of electrical connection means adapted to mate with said first plurality of connection means on said insert member; external annular groove means on said tubular portion; internal annular recess means on said inner portion of said body; and seal means mounted in said groove means and arranged to engage said recess means to prevent entry of moisture and to provide a detent which releasably couples said body to said receptacle.

2. The connector apparatus of claim 1 wherein said insert member and said receptacle are each made up of a rigid thermoplastic material, the outer surfaces of said outer section of said insert member being molecularly bonded to confronting surfaces of said body.

3. The connector apparatus of claim 2 further including key and slot means for rotationally orienting said insert member with respect to said receptacle means.

4. The connector apparatus of claim 2 further including an outwardly directed flange at the outer end of said outer portion of said body member to provide a means by which said body can be grasped by hand during make-up and release of said apparatus.

5. The connector apparatus of claim 2 further including a longitudinal flange on said outer portion of said body having an inwardly facing surface adapted to be engaged by a hand tool to aid in disconnecting of said connector apparatus.

6. The connector apparatus of claim 2 wherein said seal means is a silicone O-ring seal.

7. The connector apparatus of claim 6 wherein said recess means has a depth that is about 75% of the radial thickness of said O-ring seal.

8. The connector apparatus of claim 6 further including an annular inclined surface adjacent the inner end face of said body that coacts with said O-ring seal to expand said lower portion and allow said O-ring to snap into said recess means.

9. A receptacle for use in connecting a seismic leader cable having a plurality of pairs of insulated electrical conductors to a signal processing means, comprising: a body having a central section, and upper tubular portion and a lower tubular portion; a plurality of electrical connector means extend from within said lower portion to within said upper portion through said central section; flange means extending outward from the lower end of said central section for use in attaching said receptacle to the wall of an enclosure; an external annular groove in said upper portion; and a silicone O-ring seal carried in said groove.

10. The receptacle of claim 9 wherein said groove has a depth that is about 75% of the radial thickness of said O-ring seal.

11. The receptacle of claim 9 further including face seal means on said flange for sealing said receptacle with respect to the wall of an enclosure.

12. The receptacle of claim 9 wherein said body is made of a rigid thermoplastic material.

13. A plug apparatus for use in connecting a seismic cable having a plurality of insulated electrical conductors to a multi-pin receptacle, comprising: a generally cylindrical body made of a resilient elastomer material, said body having an outer portion and an inner portion; means for bringing said conductors into said upper portion at substantially a right angle to the longitudinal axis of said lower portion; an insert member in said lower portion and carrying a plurality of electrical connection means adapted to be connected to respective ones of said conductors, said insert member being made of a rigid thermoplastic material that is bonded to said inner portion; said insert member having a lower section with outer wall surfaces that are laterally spaced from inner wall surfaces of said inner portion of said body to form an annular space therebetween; and internal annular recess means in said inner portion adapted to receive a seal ring that couples said plug apparatus to a receptacle.

14. The plug apparatus of claim 13 further including inclined surface means on the end face of said inner end portion for causing expansion thereof by said seal ring.

15. The plug apparatus of claim 13 further including an outwardly directed flange at the outer end of said outer portion to provide a means by which said body can be grasped by hand during connection and disconnection of said plug apparatus.

16. The plug apparatus of claim 15 further including inwardly facing surface means on said body adapted to be engaged by a hand tool to aid in removing said body from a mating receptacle.

* * * * *